US007857031B2

(12) United States Patent
Mihalcheon et al.

(10) Patent No.: US 7,857,031 B2
(45) Date of Patent: Dec. 28, 2010

(54) GUIDE ASSEMBLY FOR OVERHEAD SECTIONAL DOOR

(75) Inventors: Arthur Mihalcheon, Edmonton (CA); Jerry Gordon, Edmonton (CA)

(73) Assignee: Steel-Craft Door Products Ltd., Edmonton, Alberta (CA)

( * ) Notice: Subject to any disclaimer, the term of this patent is extended or adjusted under 35 U.S.C. 154(b) by 201 days.

(21) Appl. No.: 12/027,125

(22) Filed: Feb. 6, 2008

(65) Prior Publication Data

US 2009/0194241 A1 Aug. 6, 2009

(51) Int. Cl.
*E05D 15/00* (2006.01)

(52) U.S. Cl. ..... 160/201; 160/209

(58) Field of Classification Search ..... 160/201, 160/191, 192, 193, 209; 49/204, 202, 197; 16/401

See application file for complete search history.

(56) References Cited

U.S. PATENT DOCUMENTS 2,007,688 A 7/1935 McCloud
2,059,585 A * 11/1936 Kelly ..... 160/209
2,083,467 A * 6/1937 Morris ..... 160/191
2,625,221 A * 1/1953 McKee et al. ..... 160/209
3,227,205 A 1/1966 Crosswell
4,119,133 A 10/1978 Wolf
5,425,409 A * 6/1995 Guia ..... 160/201
6,047,761 A * 4/2000 Jaehnen et al. ..... 160/201
7,128,123 B2 * 10/2006 Mullet et al. ..... 160/209

* cited by examiner

*Primary Examiner*—Blairl M. Johnson
(74) *Attorney, Agent, or Firm*—Marsh Fischmann & Breyfogle LLP

(57) ABSTRACT

The guide assembly comprises corner brackets for mounting to the upper corners of a door jamb. Each corner bracket supports an elongated curvilinear track section and an elongated cam track. The curvilinear track section and the cam track each have a central concave portion. The guide assembly further comprises a support bracket which is pivotally mounted to an upper corner of the top panel of the sectional door. The pivoting support bracket has a cam follower which engages and follows the cam track, so that pivoting of the support bracket is responsive to the shaping of the cam track. The assembly is designed to steer the upper edge of the top panel away from the cable drum of a lifting assembly when passing thereby, all with the objective of reducing headroom.

7 Claims, 12 Drawing Sheets

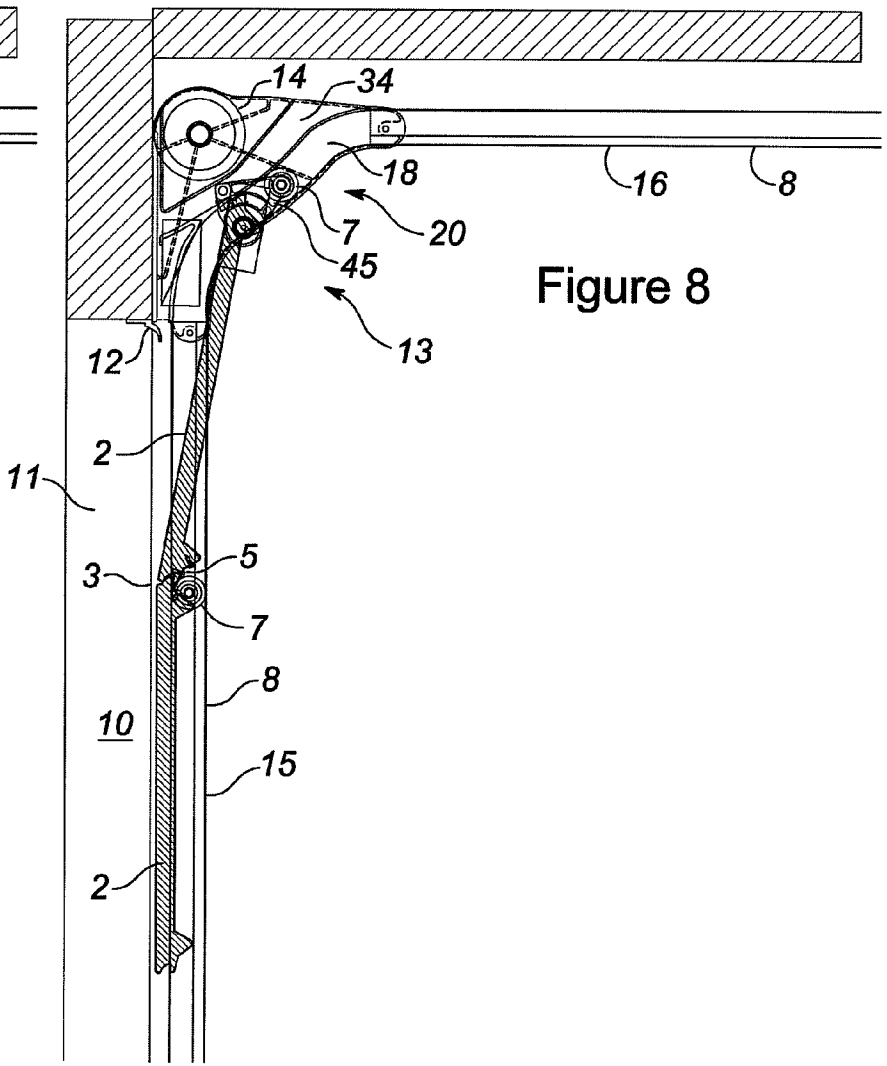
Figure 8
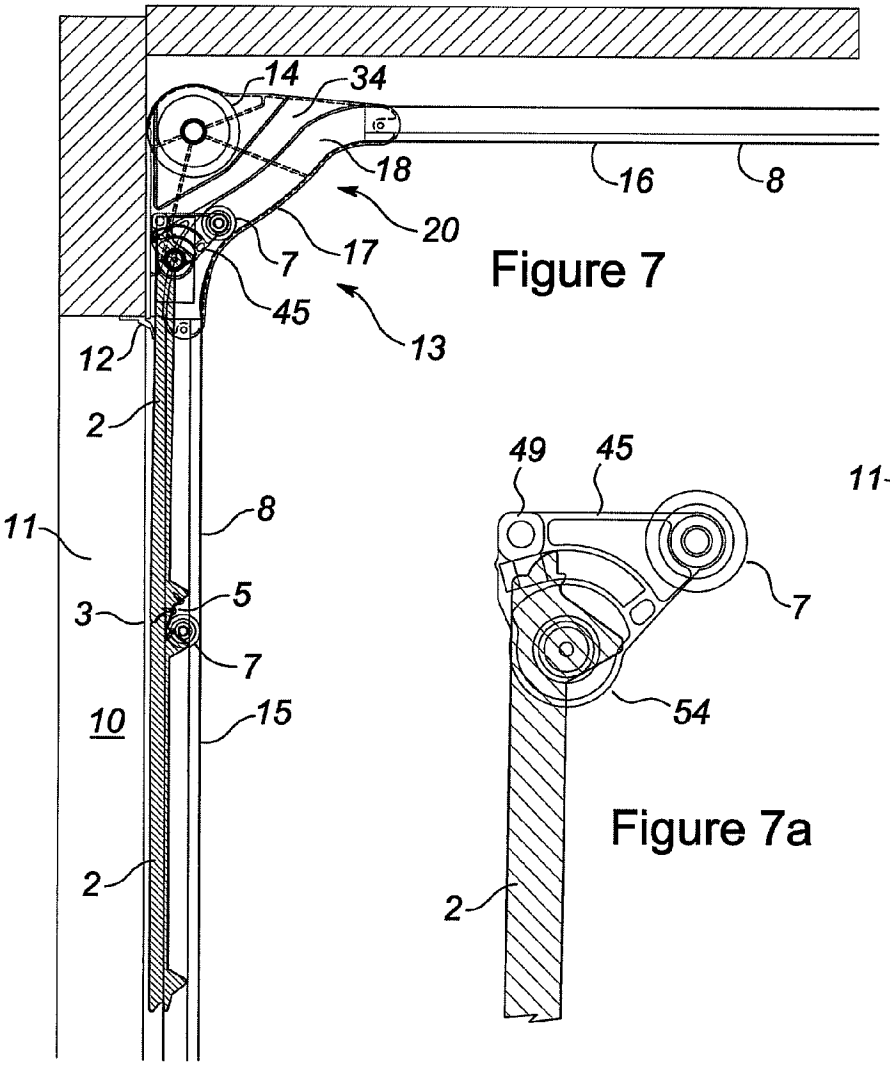
Figure 7
Figure 7a

GUIDE ASSEMBLY FOR OVERHEAD SECTIONAL DOOR

FIELD OF THE INVENTION

The present invention relates to the field of overhead sectional doors and their complementary hardware (collectively referred to herein as 'sectional door assemblies').

BACKGROUND OF THE INVENTION

Overhead sectional door assemblies are in common use in both residential and industrial building structures. A typical conventional sectional door assembly (a) is shown in FIG. 1*a*.

The sectional door assembly (a) comprises a door (m) having several vertically stacked door panels (b) connected together along their abutting edges by metal hinges (not shown). Each door panel (b) supports a pair of roller hinges (d) at its upper corners. Each roller hinge (d) has a roller (e) which engages and runs along one of a pair of C-shaped tracks (f) secured to the jamb (g) at the sides of the door opening.

Each track (t) has a lowermost, upwardly extending section (i), an uppermost, inwardly extending, generally horizontal section (j) and a curved corner section (k) joining the upwardly extending and horizontal sections (i), (j). The curved corner section (k) usually has a single radius, typically falling in the range 12-15 inches, and bends through about 90°.

A torsion spring lifting assembly (l) is commonly provided to lift the sectional door (m). This lifting assembly (l) usually comprises a horizontal shaft (n) rotatably mounted to the header or jamb (g) above the door opening (h). The shaft (n) carries a cable drum (o) at each of its ends. A torsion spring is connected to and coiled around the central portion of the shaft (n). A lift cable is connected between each drum (o) and the underlying bottom corner of the sectional door (m). If the tensioned torsion spring is released, it rotates the shaft (n) and drums (o) and winds in the cables, thereby lifting the door (m) along the tracks (f).

A door operator (not shown), usually comprising a jack shaft driven by an electric motor, is commonly provided to push the door (m) toward the upright closed position from the horizontal open position.

Together, the door operator and torsion spring lifting assembly require a significant amount of space or "headroom" above the door. Typically, in a residential garage case, about 10-12 inches of headroom is needed. If the headroom is reduced an inch or two, this will bring the cable drums (o) closer to the top of the sectional door (m). There is then a risk that the upper end of the top panel (b) will contact the cable drums (o) as the panel travels through the curved corner track sections (k).

Builders have long pressed manufacturers of sectional door assemblies for reduction in headroom requirements.

It has been conventional to incline the upwardly extending sections of the tracks away from the door jamb, from the bottom to the top. This is done primarily to break the door (m) away from the weather stripping (t) so that the door will not wear the stripping as the door moves up and down. It has also allowed the headroom to be reduced to about 10-12 inches.

The use of inclined tracks, however, carries with it the penalty of having to use "wedge-type hardware". By this is meant that the track mounting brackets, which connect the tracks (f) to the door jamb (g), and the panel roller hinges (d) necessarily are "stepped" or vary in size. It will be appreciated that, while the sectional door (m) is to roll along inclined tracks, it still needs to be vertical when closed, to press against the weather stripping (t) mounted on the vertically oriented door jamb and thereby provide an effective seal against wind. To accomplish this, wedge-type hardware needs to be used. Wedge-type hardware is expensive.

With this background in mind, it therefore is one object of the present invention to modify a sectional door assembly so that it can work in a reduced headroom, for example in the order of 8 to 10 inches.

It is a preferred object to provide an assembly that does not need inclined tracks and wedge-type hardware.

SUMMARY OF THE INVENTION

A pair of guide assemblies are provided (one for each side of the sectional door). The guide assemblies are adapted to control the positioning of the upper end of the top panel of an overhead sectional door, as it moves back and forth between closed and open positions, so as to keep the panel from contacting the lifting assembly, particularly the cable drums, when the headroom is reduced, for example to 8-10 inches.

In one embodiment, each guide assembly combines the following elements:

- a corner bracket for mounting to an upper corner of the door jamb, the corner bracket supporting an elongated, curvilinear guide means, for example a track section;
- a support bracket, pivotally mounted to the upper corner of the top panel, the support bracket being operative to pivot in the course of top panel travel, the pivoting support bracket having means, for example a rotatable roller, for engaging and following the curvilinear guide means;
- composite means for controlling pivoting of the support bracket in the course of travel through the guide means, said composite means comprising an elongated first part, for example a cam track supported by the corner bracket, and a second part, for example a cam follower, connected with the pivoting support bracket, the second part engaging the first part so as to be controlled thereby, more particularly so that pivoting of the support bracket is responsive to the shaping of the first part;
- the elongated curvilinear guide means and the first part of the composite means each preferably having a generally concavely configured central portion for guiding the top panel away from the lifting assembly;
- the curvilinear guide means, pivoting support bracket and composite means cooperating to maintain the top panel of the sectional door out of contact with the lifting assembly in the course of the door moving back and forth between open and closed positions.

In a preferred or optional feature, the curvilinear guide means is a track section having three curved portions in sequence, namely: a convex first portion that connects with the upper end of the upwardly extending track section and guides each upwardly rolling roller inwardly as the door opens, to thereby position the adjoining panel obliquely; a concave central or second portion that generally mirrors the curvature of the adjacent cable drum and is operative to guide the upper end of the top panel away from and past the cable drum while maintaining it out of contact therewith; and a convex third portion that guides the top panel toward horizontal (all when the sectional door is opening).

The pivoting support bracket preferably is generally triangular in shape having a cam follower positioned at its upper apex, a pivot connection located at its rearward apex and a roller at its forward apex.

By way of explanation:

The pivoting capability of the support bracket plays a role in enabling the bracket to "flatten out" at the end of the opening travel, to bring the top panel roller into alignment with the other rollers and avoid a "back-bending" action by the top panel. (By back-bending is meant that the top panel will adopt an upwardly canted position (as shown in prior art FIG. 1*d*) relative to the next panel, instead of being coplanar therewith. Back-bending will occur if the roller bracket is "stepped" and rigid.) The pivoting capability further allows the support bracket to cooperate in bringing the top panel to an upright position at the end of the closing travel, whereby the panel may be caused to effect a good seal with the jamb weather stripping, even though the top roller may still remain in the curved section of the track. The pivoting capability also plays a role in enabling the support bracket to cooperate with the curvilinear track section and the cam assembly, when the top panel is passing through said track section, to closely control the path taken by the upper end of the top panel and keep it away from the cable drums, even though the headroom may have been slightly reduced from the conventional amount; and the provision and shaping of the cam assembly is designed to cooperate in causing the top panel to be pressed firmly against the jamb weather stripping in the closed position to resist wind pressure. The cam assembly also, as previously mentioned, has a controlling effect on the orientation of the pivoting support bracket as it moves through the curvilinear track section, to assist in maintaining the top panel out of contact with the cable drums.

DESCRIPTION OF THE DRAWINGS

FIG. 7 is a side view showing the guide assembly (corner bracket and pivoting support bracket) in the fully closed position;

FIG. 7*a* is an enlarged side view showing the pivoting support bracket and top panel in the fully closed position of FIG. 7;

FIG. 8 is a side view showing the orientation of the pivoting support bracket as it traverses through the concave second portion of the curvilinear track section and guides the upper end of the door top panel away from the adjacent cable drum;

DESCRIPTION OF THE PREFERRED EMBODIMENT

Figure 1B:
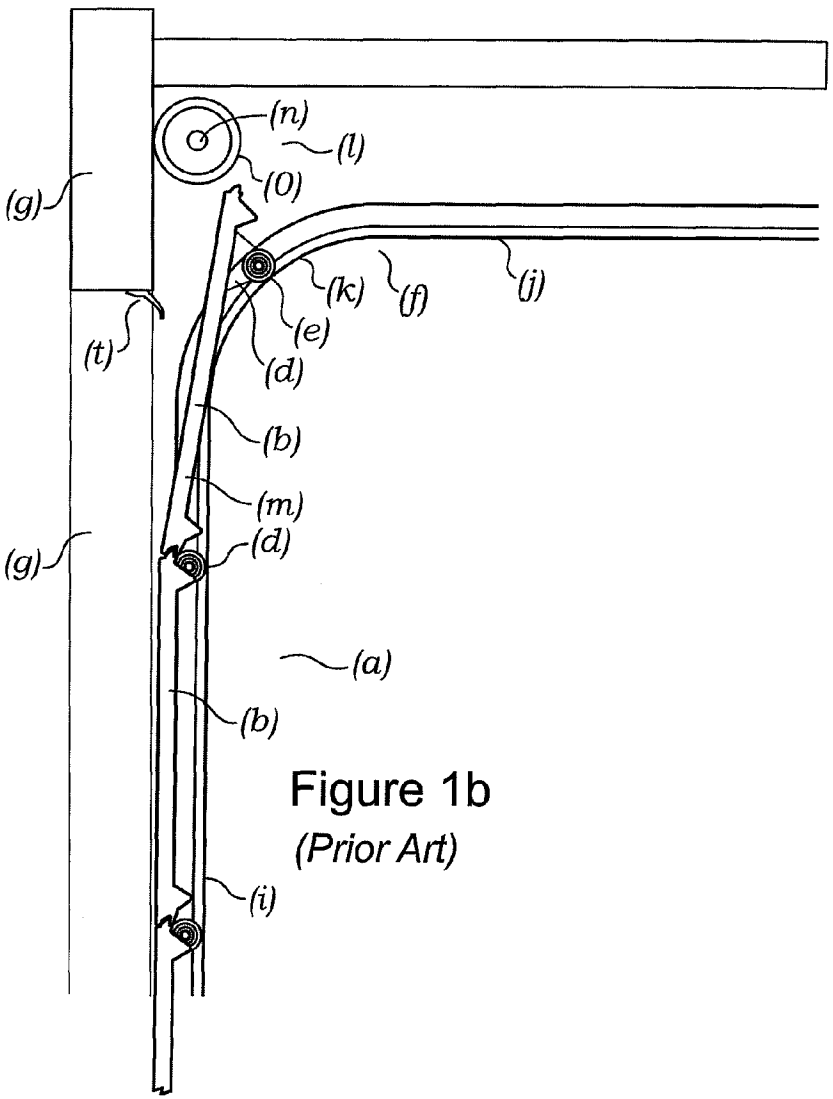
Figure 1b (Prior Art)
FIGS. 1*a*-1*d* are simplified side views showing the upper panels of a sectional door advancing along a track from a closed upright position (FIG. 1*a*), past a cable drum (FIGS. 1*b*, 1*c*) to a horizontal open position (FIG. 1*d*), in accordance with the prior art.
Figure 1A:
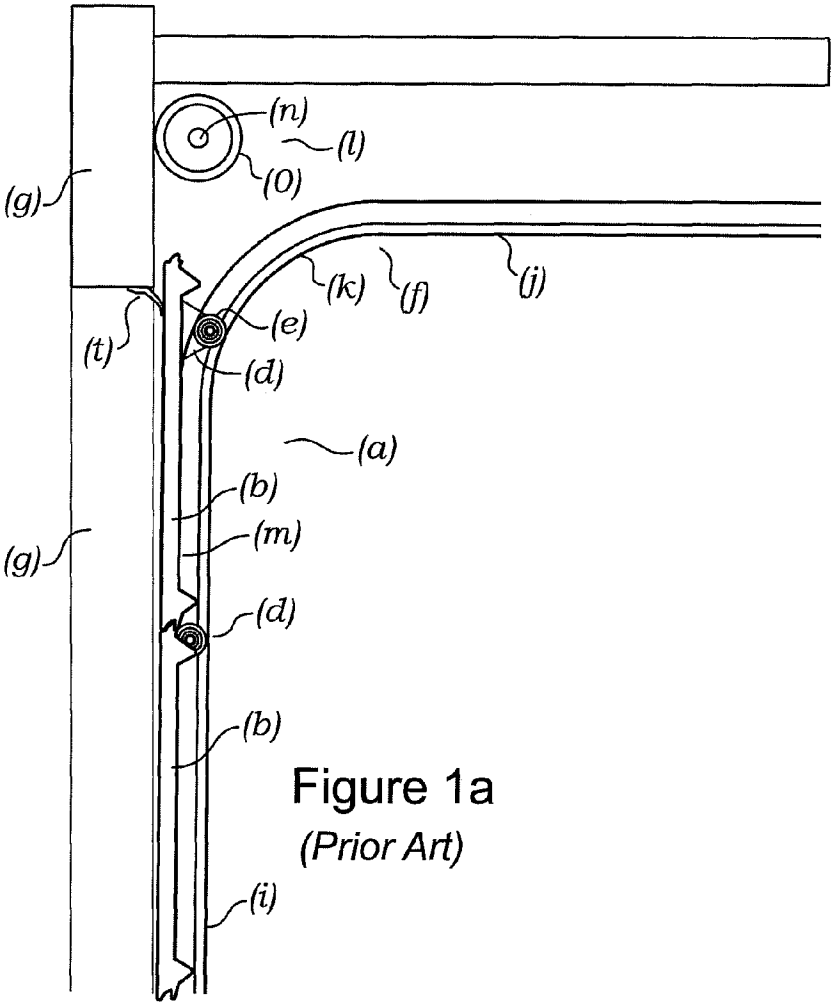
Figure 1a (Prior Art)
Figures 1C, 1D:
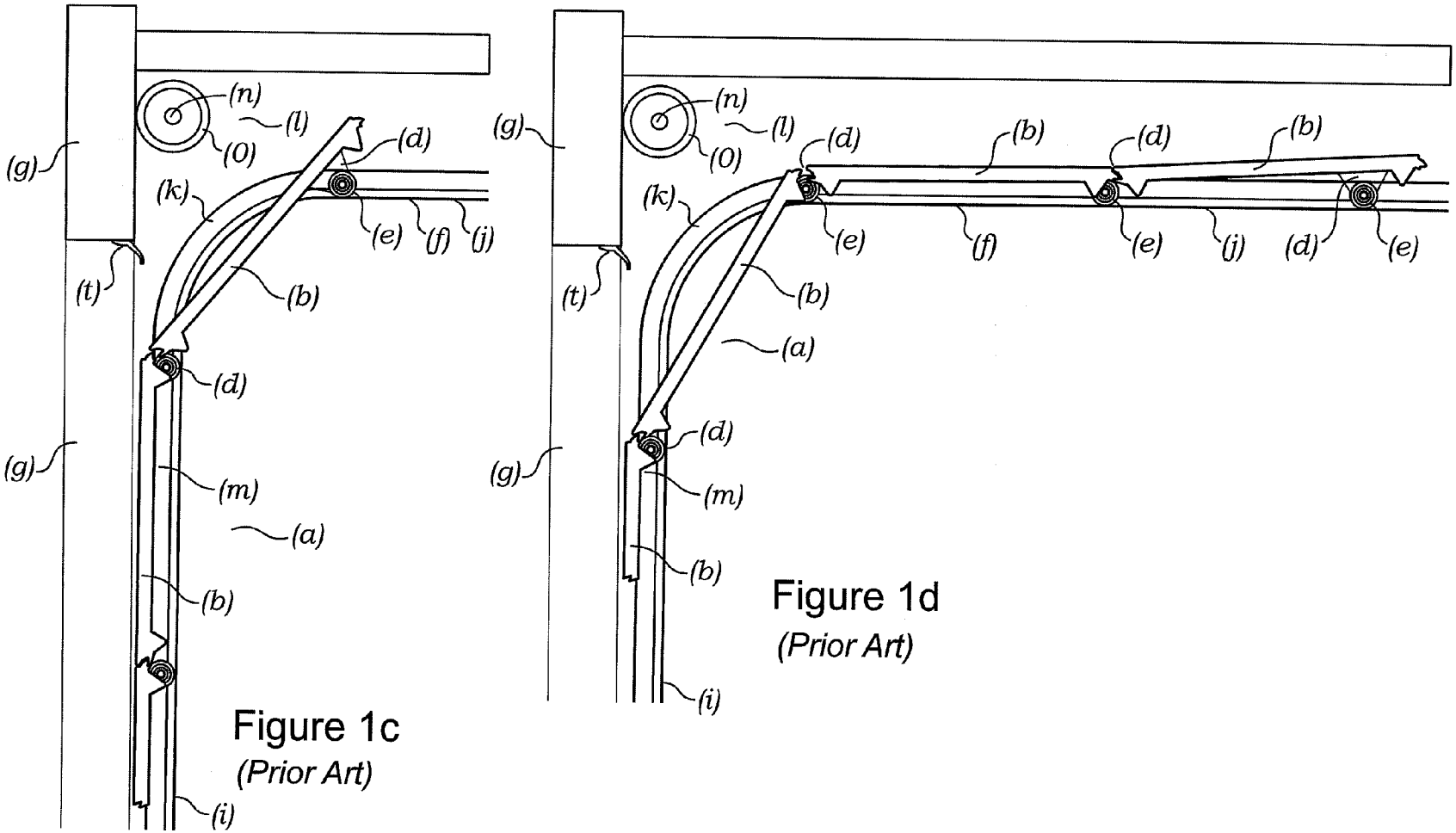
Figure 1c (Prior Art)
Figure 1d (Prior Art)
Figure 2:
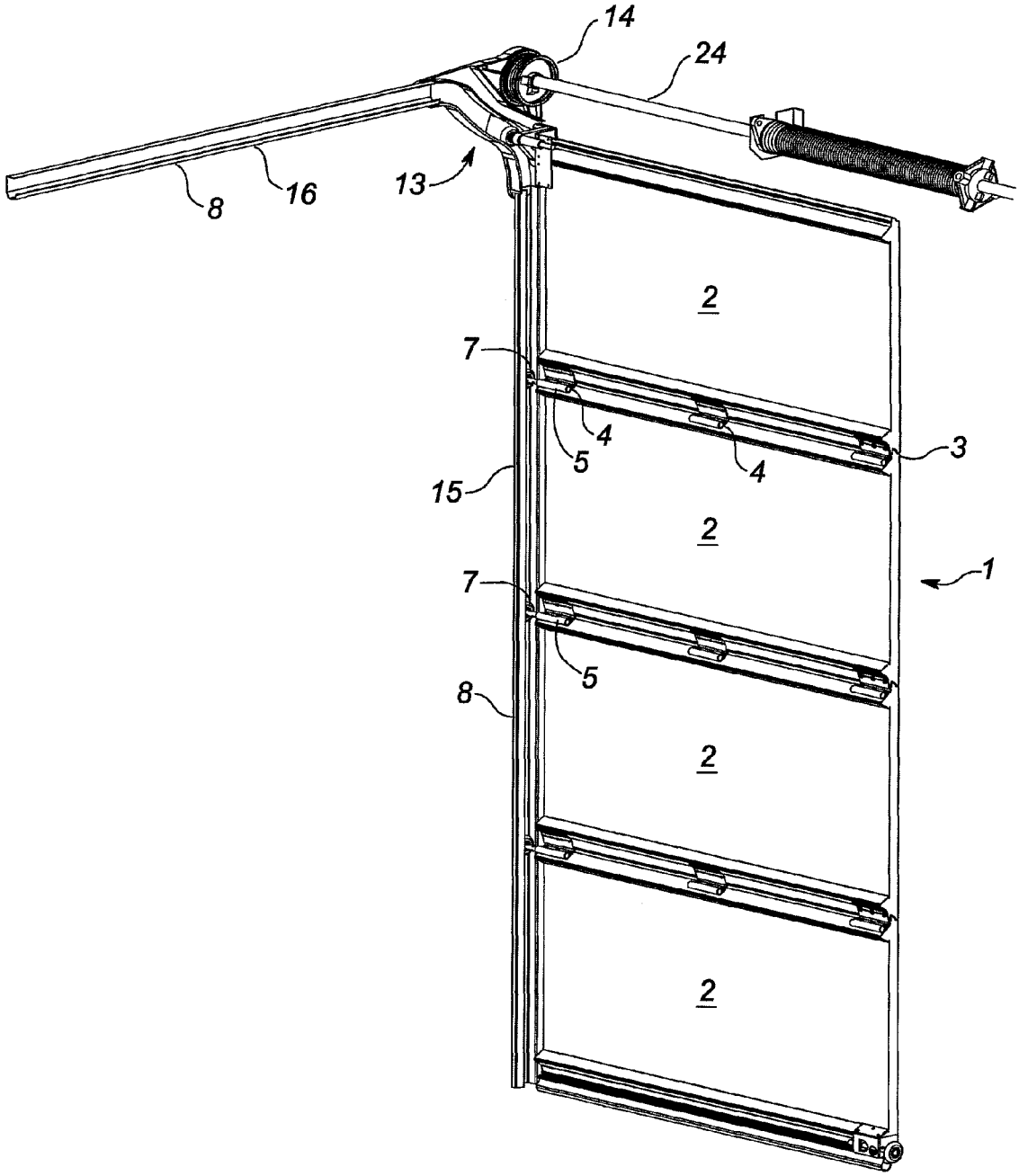
FIG. 2 is a perspective view of a guide assembly in accordance with the present invention, shown in conjunction with a sectional door, roller track and lifting assembly.
Figures 11, 11A:
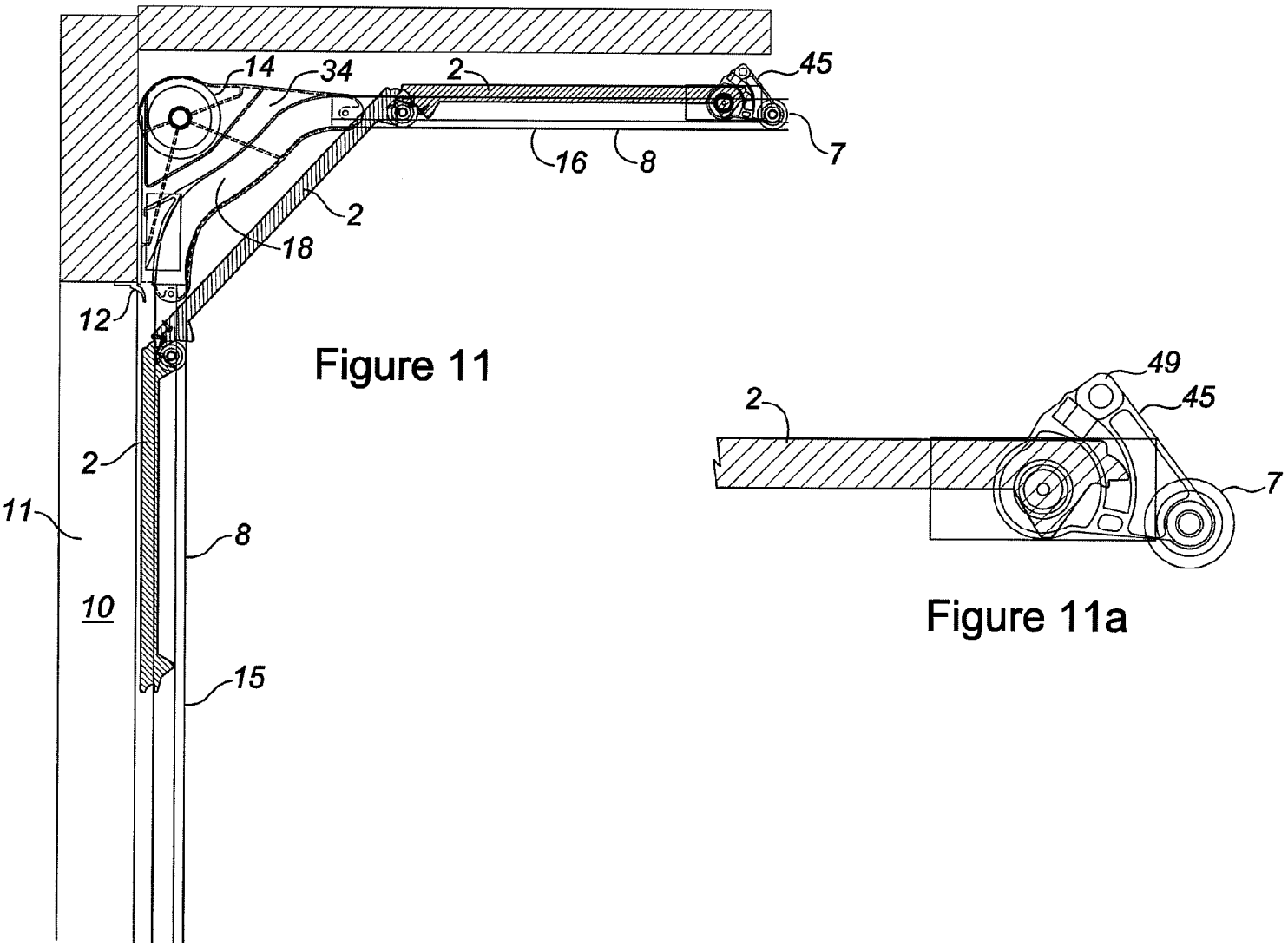
FIG. 11 is a side view showing the orientation of the pivoting support bracket in the course of travelling along the horizontal section of the track-the bracket has "flattened out" so that the panel is not canted and is in position to align with the following panels when the sectional door is fully open.
FIG. 11*a* is a partial expanded side view of the pivoting support bracket and upper end of the sectional door top panel as shown in FIG. 11.
Figure 12:
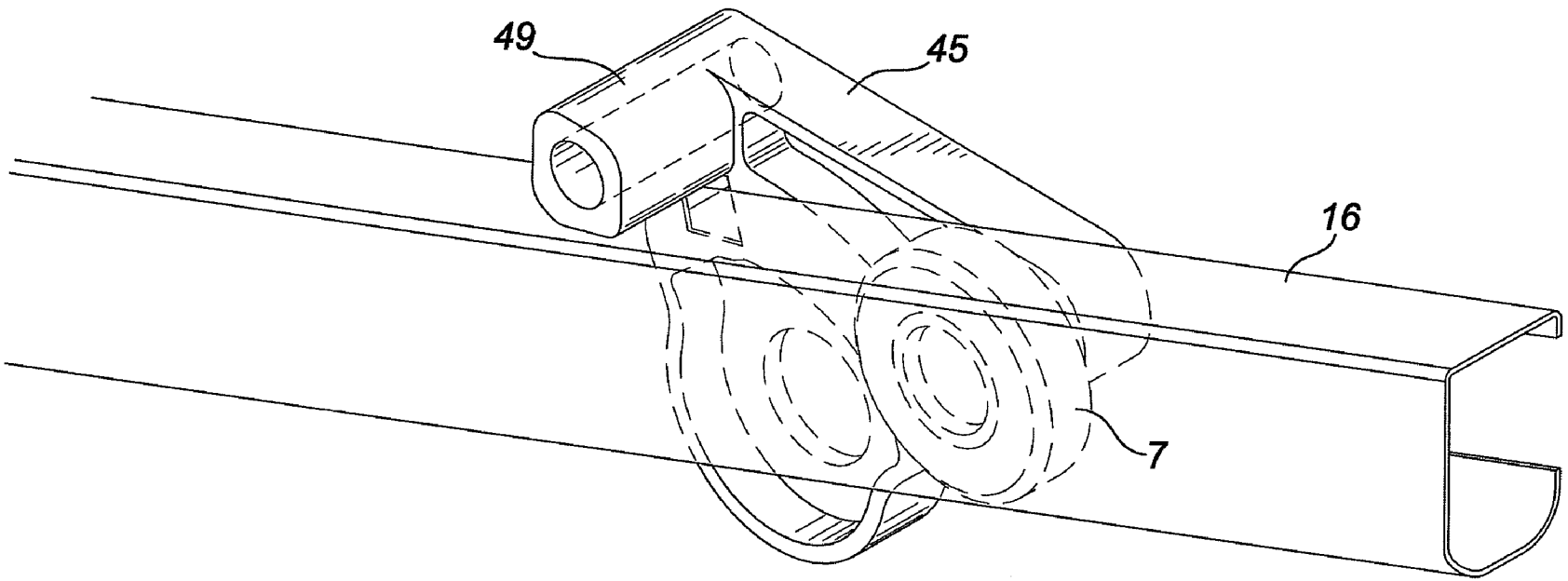
FIG. 12 is a perspective view showing the position of the cam follower on top of the upper side wall of the horizontal section of the roller track.

Having reference to FIGS. 2 and 11, an overhead sectional door 1 is shown in the closed and partially open positions. The sectional door 1 comprises several vertically stacked panels 2 hinged together along their abutting edges 3 by hinges 4. Each panel 2 carries a pair of roller support brackets 5 mounted thereto at its upper corners 6. Each roller support bracket 5 carries a rotatable roller 7 that engages one of the tracks 8. (Only one track 8 is shown.) The tracks 8 are mounted to the jamb 10 of a door opening 11.

Each track 8 comprises a lowermost, substantially vertical track section 15, an overhead, substantially horizontal track section 16 and a corner curvilinear track section 17. The curvilinear track section 17 connects track sections 15, 16. Each track 8 has a C-shaped configuration and defines a channel 18 through which the rollers 7 move.

As shown in FIG. 7, the upwardly extending track section 15 is parallel with the vertical door jamb 10.

The Corner Bracket and Curvilinear Track Section

A pair of corner brackets 20 are provided, each mounted to one of the upper corners of the door jamb 10. Each corner bracket 20 extends perpendicularly out from the door jamb 10.

Figure 5:
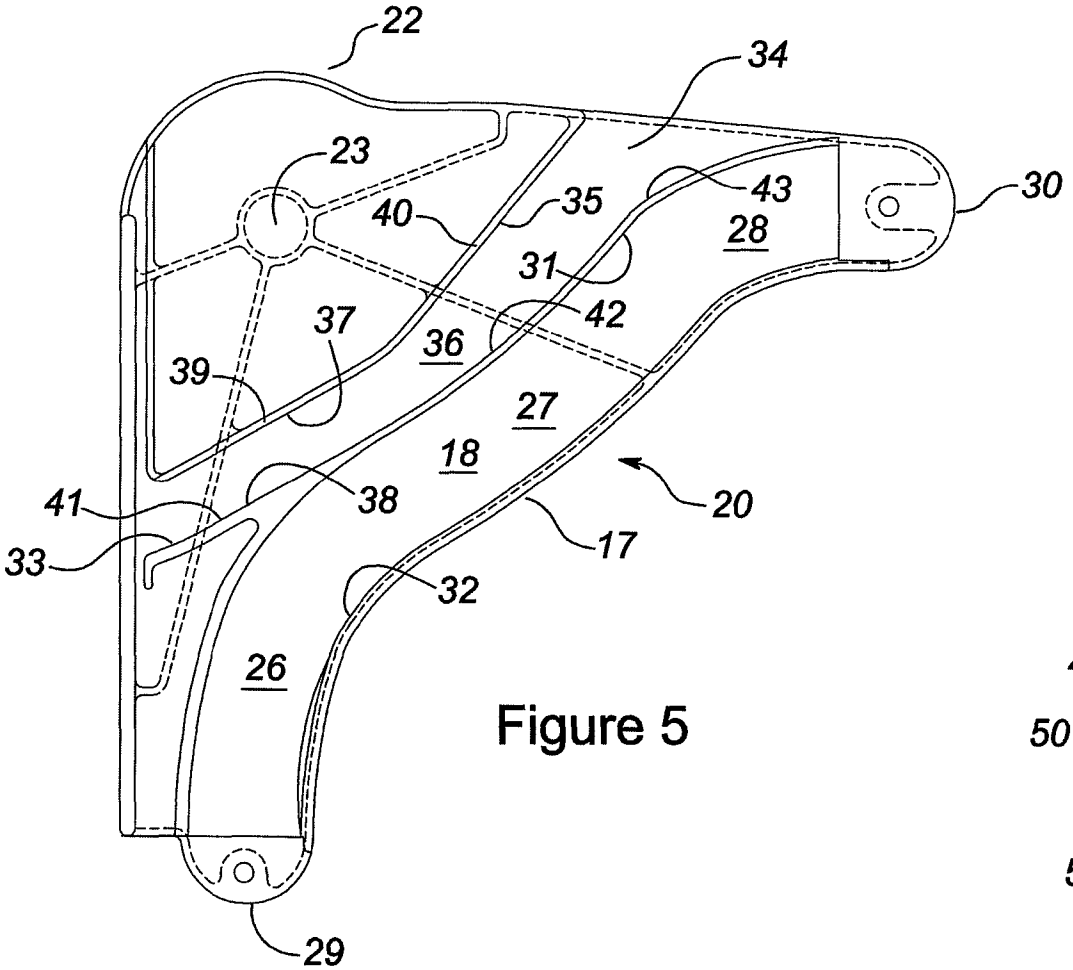
FIG. 5 is a side view of a corner bracket which forms part of the guide assembly, said corner bracket supporting a curvilinear roller track and a cam track.

A corner bracket 20 is shown by itself in FIG. 5. At its upper end 22, it forms an aperture 23 for receiving and supporting one end of the torsion shaft 24 of the lifting assembly 25.

The elongated curvilinear track section 17 is supported or carried by and extends across the corner bracket 20 at its lower end. The track section 17 comprises a convex first portion 26, a concave second portion 27 and a convex third portion 28.

The curvilinear track section 17 has one end 29 that is substantially vertically oriented and the other end 30 substantially horizontally oriented, for connection with the vertical and horizontal track sections 15, 16.

A pair of parallel side walls 31, 32 define the channel 18 formed by the curvilinear track section 17.

The Cam Track

Figure 4:
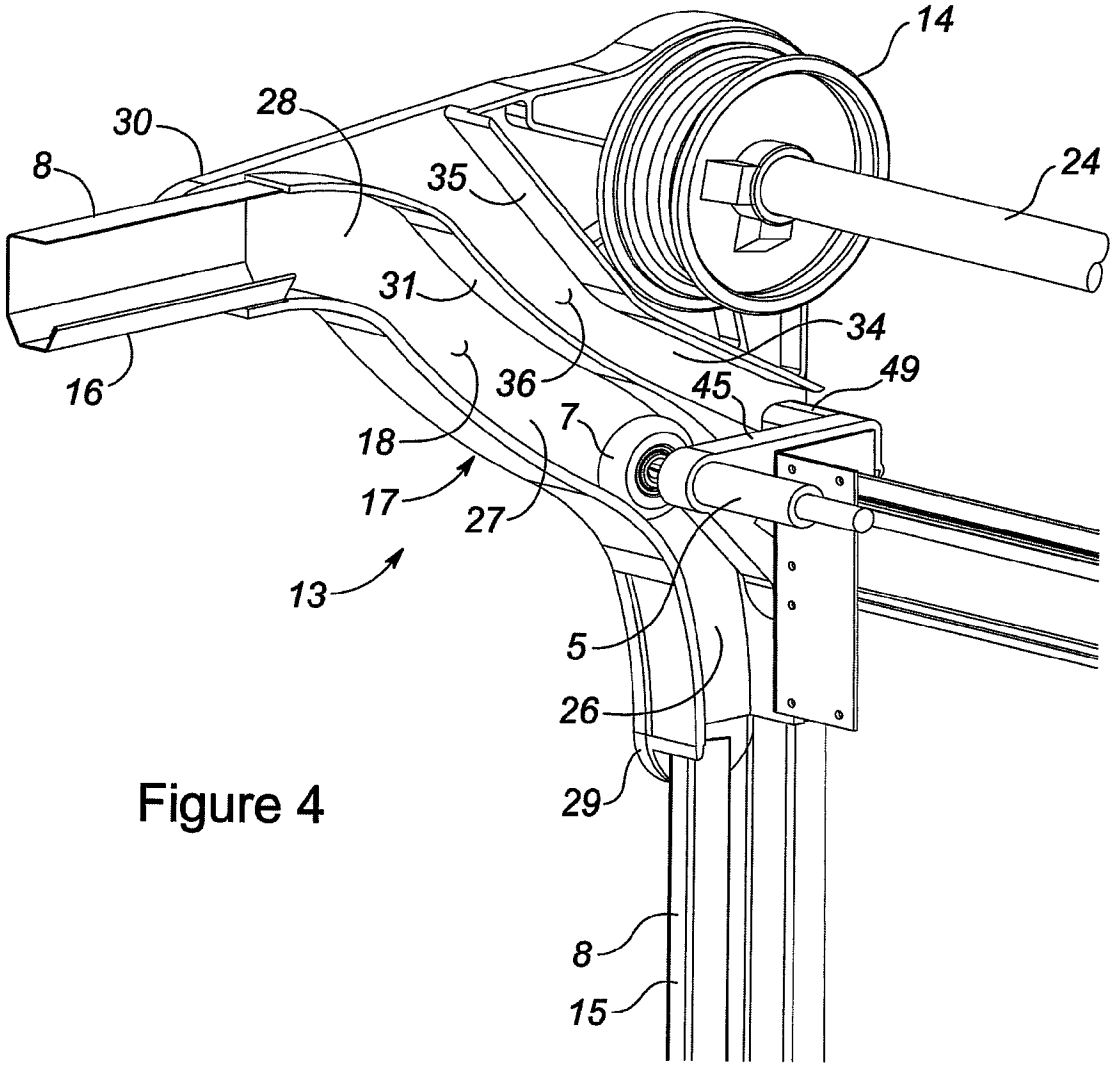
FIG. 4 is a still larger scale perspective view of the guide assembly shown in FIGS. 2, 3.
Figure 13:
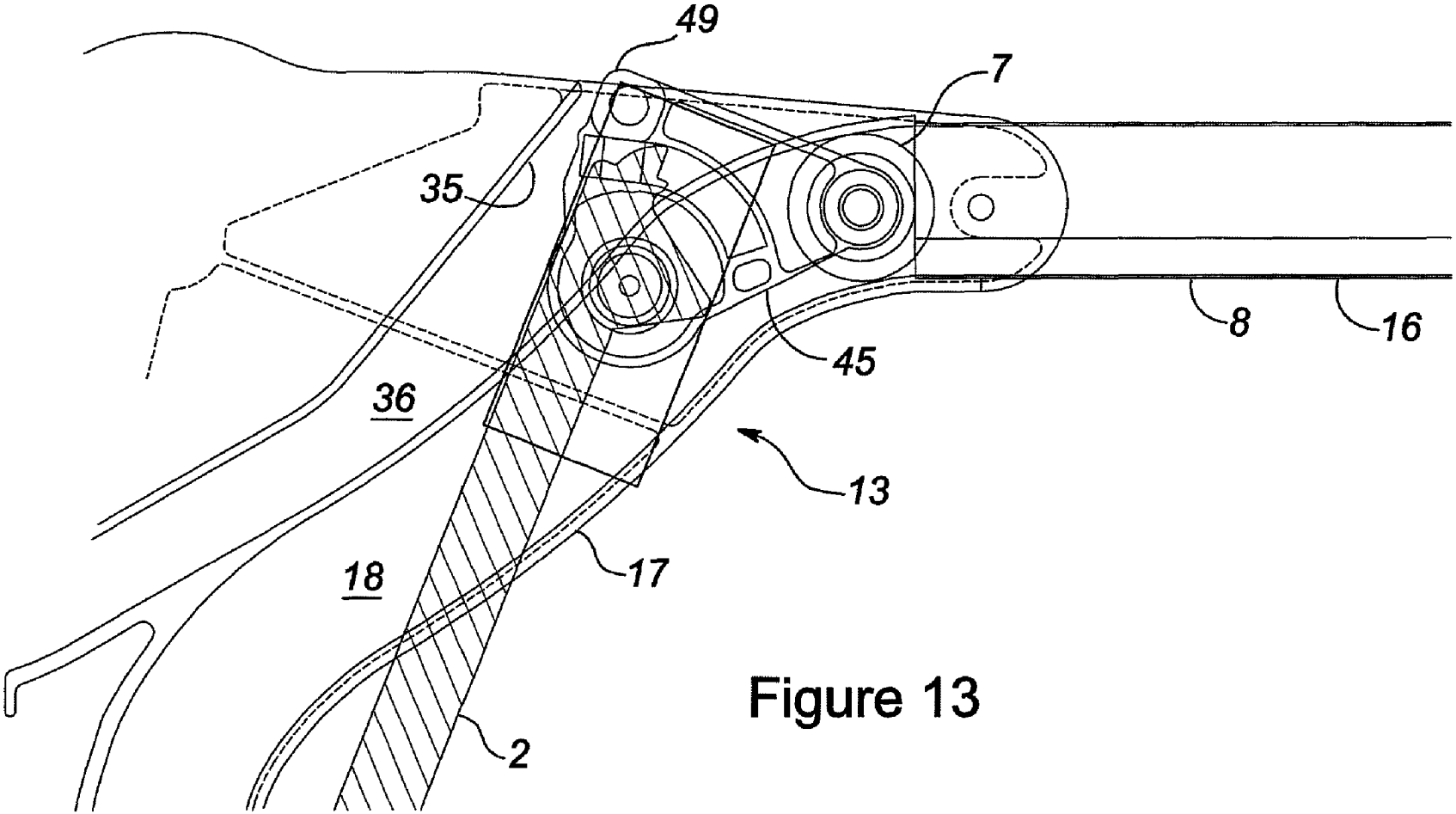
FIG. 13 is a side view showing the pivoting support bracket as its cam follower is about to enter the inlet of the cam track on the corner bracket during closing travel.

The corner bracket 20 also supports an elongated cam track 34 extending thereacross, contiguous to the curvilinear track section 17. The cam track 34 is formed by the upper side wall 31 of the curvilinear track section 17 and an extension 33 thereof, together with a top side wall 35. The cam track 34 provides a cam channel 36 defined by upper and lower cam surfaces 37, 38. The cam surfaces 37, 38 each function separately during different modes of door movement to guide and control the cam follower 49 and thereby control the pivoting of the support bracket 45. More particularly the cam follower 49 engages the lower cam surface 38 in the course of opening travel and the upper cam surface 37 in the course of closing travel (as shown by FIGS. 4, 8 and 13).

The top side wall 35 of the cam track 34 has angularly arranged, first and second portions 39, 40, each of generally straight line configuration, which provide the upper cam surface 37. The lower cam surface 38 has first, second and third portions 41, 42, 43. The second portion 42 of the lower cam surface 38 is concave in configuration; the first portion 41 is generally straight and the third portion 43 is convex.

Shaping of Curvilinear and Cam Tracks

The shaping of the track section 17 and cam track 34 illustrated in the Figures correspond closely with a prototype built and tested by applicants. Those skilled in the art of computer modelling will be able to work out the specific shaping and dimensions appropriate for their circumstances.

The Pivoting Support Bracket

Figure 6:
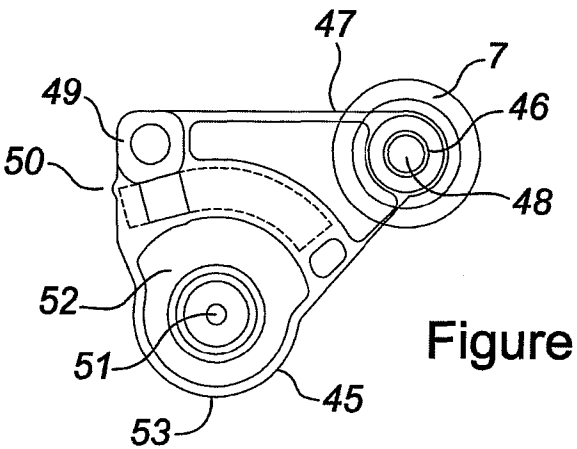
FIG. 6 is a side view of a pivoting support bracket forming part of the guide assembly, said bracket having a track roller and cam follower.
Figure 6A:
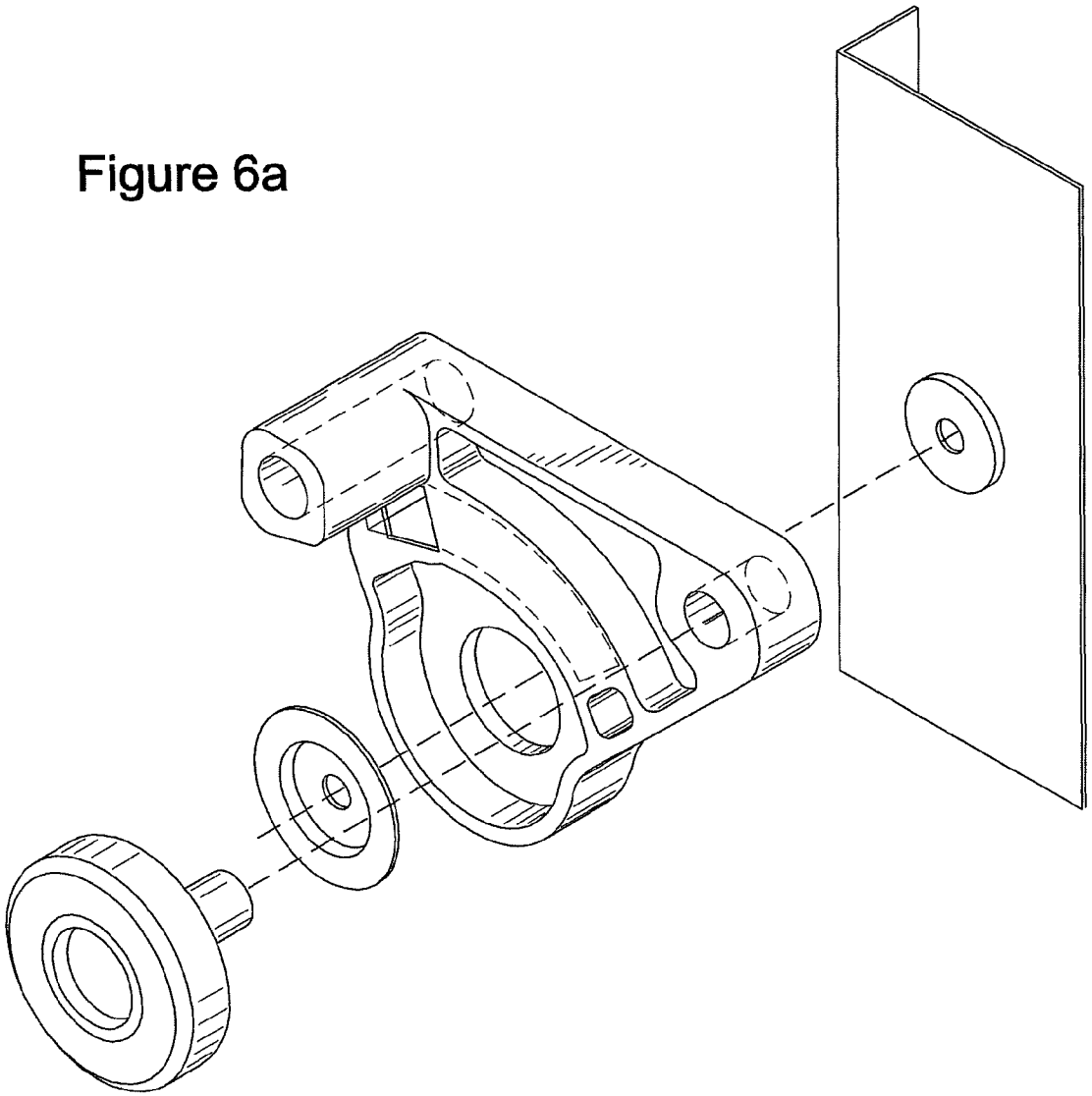
FIG. 6*a* is a perspective exploded view of the pivoting support bracket of FIG. 6.
Figure 10:
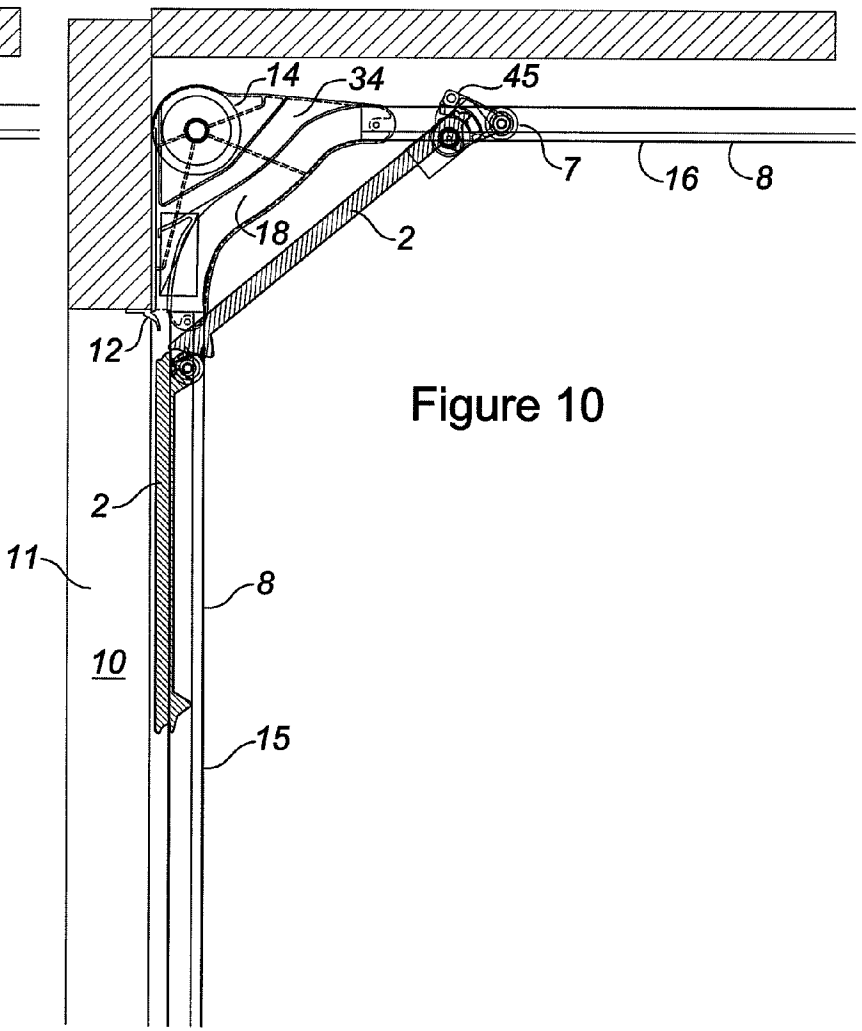
FIG. 10 is a side view showing the orientation of the pivoting support bracket as it advances along the horizontal section of the roller track.

Having reference to FIGS. 6 and 6*a*, the pivoting support bracket 45 is generally triangular in shape. When at rest in the fully open position shown in FIGS. 6, 11, it comprises: an aperture 46 in its front apex 47, for receiving the shaft 48 of a roller 7; an outwardly protruding cam follower 49 at its upper apex 50; and an aperture 51 and recess 52 at its rear apex 53 for receiving a washer/bolt/nut pivot assembly 54 (partially shown in FIG. 6*a*) for pivotally connecting the bracket 45 with the upper end of the top panel end brace 55.

From the foregoing it will be seen that a pair of guide assemblies 13 are provided, one at each upper corner of the door opening 11. Each guide assembly 13 comprises the combination of a corner bracket 20, carrying a curvilinear track section 17 and a cam track 34, and a support bracket 45, pivotally connected to an upper corner 6 of the top panel 12, which engages the cam track 45 by means of the cam follower 49 and which further engages the curvilinear track section 17 by means of the top panel roller 7.

Operation

Figure 3:
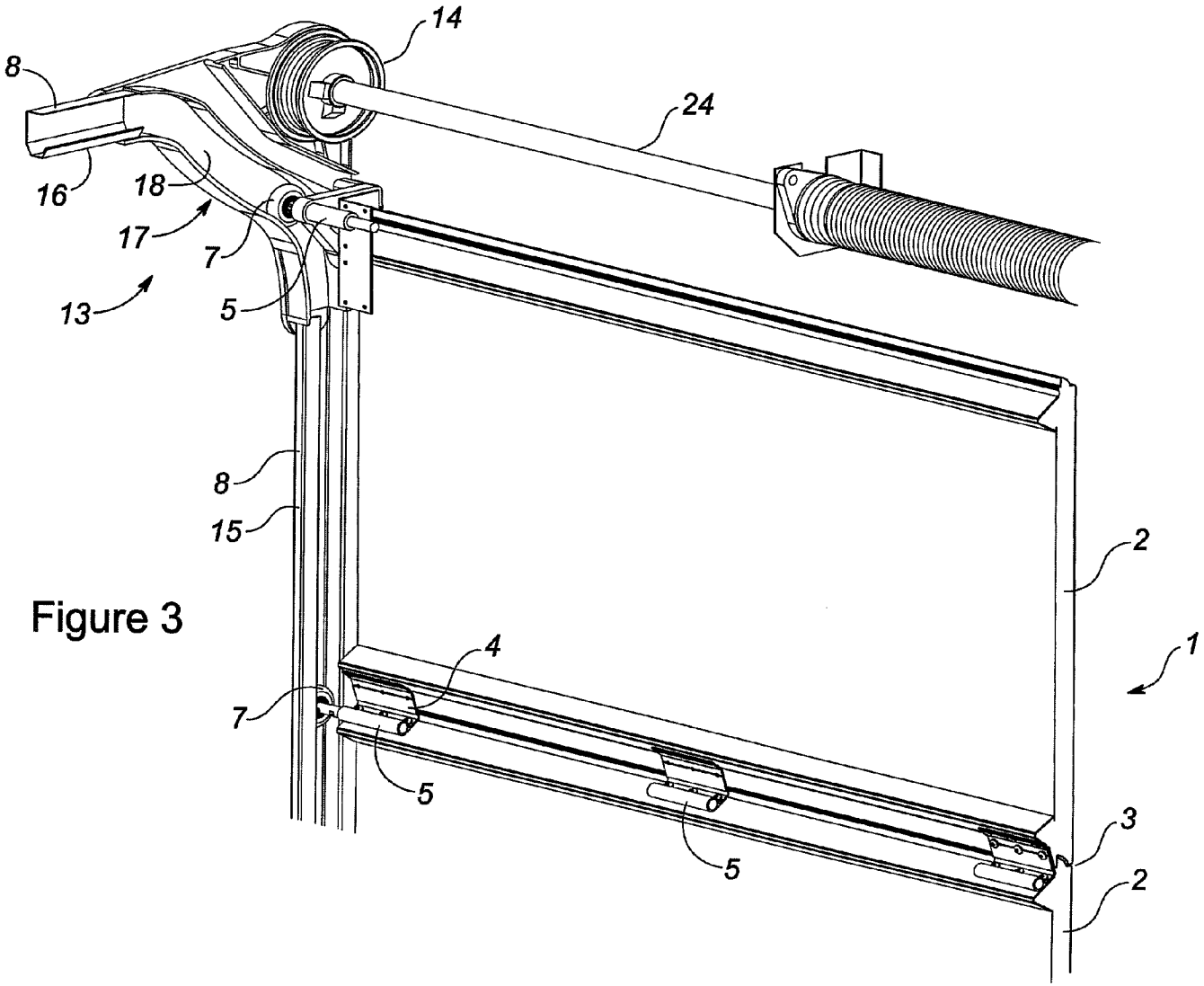
FIG. 3 is a larger scale perspective view of the guide assembly and associated components as shown in FIG. 2.

The operation will be described with reference to only one guide assembly 13. However it will be appreciated that the two guide assemblies work in unison, the same way, in conjunction with the sectional door 1. In the door-closed position shown in FIGS. 3, 7, the cam follower 49 is located against the lower cam surface 38 provided by the extension 33 of the cam track's lower side wall 31. As a consequence, the pivoting support bracket 45 is oriented so as to position the top panel 2 vertically. The top panel 2 effectively seals against the weather stripping 12 affixed to the door jamb 10. As shown in FIG. 7, the top panel roller 7 is positioned within the curvilinear track section channel 18 at the beginning of the concave second portion 27.

Having reference to FIGS. 7-10, as the lifting assembly 25 acts to pull the door upwardly toward the open position, the top panel roller 7 advances on its opening travel through the track's concave second portion 27; simultaneously the cam follower 49 interacts with the lower cam surface 38 (which is also concave at this point), to pivot the support bracket 45 and drive the rear apex 53 downwardly, thereby distancing the upper portion of the top panel 2 away from the cable drum 14, as it passes the drum. At the same time, the top panel 2 is pivoting through a sequence of oblique positions.

Figure 9:
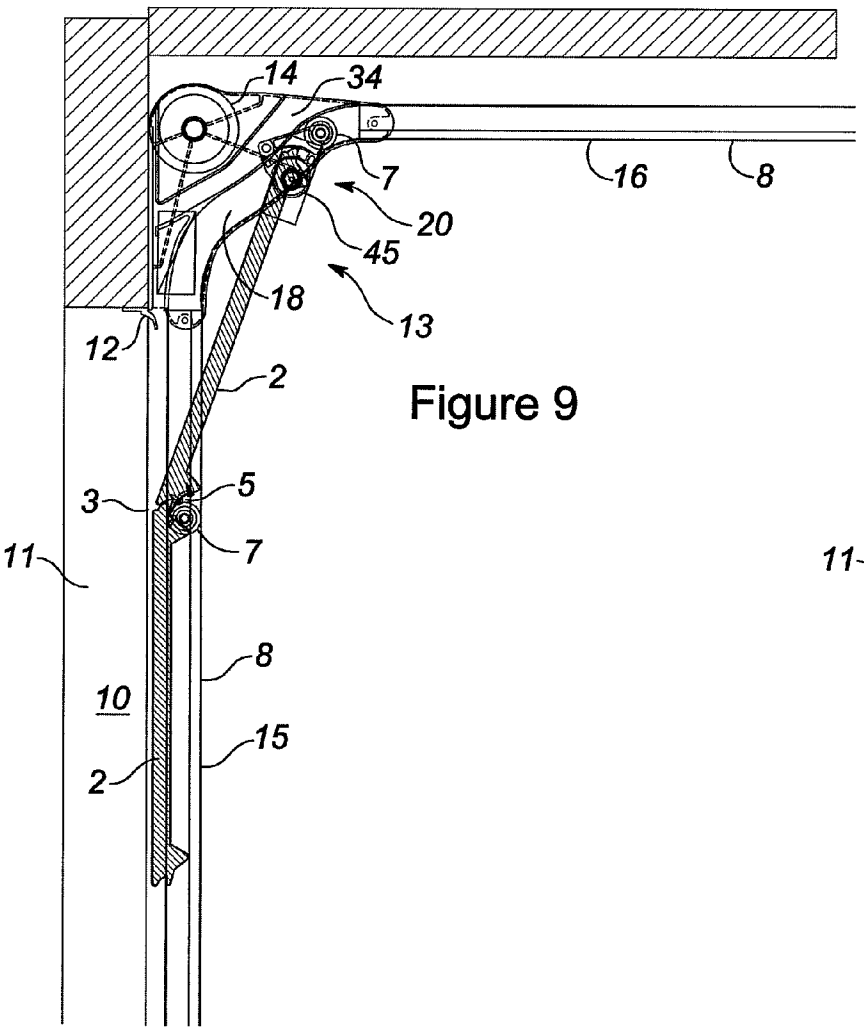
FIG. 9 is a side view showing the orientation of the pivoting support bracket as it traverses through the convex third portion of the curvilinear track section and guides the top panel toward horizontal.

Having reference to FIG. 9, as the top panel roller 7 advances through the track's convex third portion 28, the cam follower 49 rises as it rides along the corresponding convex lower cam surface 38. The cam follower 49 is now advancing toward the innermost end of the cam surface 38 which is approaching a horizontal disposition. The top panel 2 is simultaneously pivoting progressively toward the horizontal.

Having reference to FIG. 13, as the top panel roller 7 advances in the course of closing travel, the cam follower 49 contacts the innermost end of the upper side wall 35 of the cam track 34 and then engages and follows the upper cam surface 37. As a result, it is guided downwardly, to thereby work with the roller 7 in the curvilinear track section 17 to draw the upper portion of the top panel 2 away from the cable drum 14. As the door 1 continues on its closing travel, the top panel 2 approaches a vertical position and the cam follower 49 drops into the position shown in FIG. 7.

Applicants contemplate that various changes may be made in the embodiment described by substituting mechanical equivalents for the components described. The scope of the invention is defined by the claims now following.

We claim:

1. A guide assembly, for use in controlling the position of the top panel of an overhead sectional door to prevent the panel from contacting a door lifting assembly, mounted on the jamb of a door opening, as the panel moves past the lifting assembly, comprising:

a corner bracket for mounting on the jamb, the corner bracket supporting an elongated curvilinear guide means comprising a sequence of convex, concave and convex portions;

a support bracket having means for pivotally mounting the support bracket to an upper corner of the top panel, the support bracket further having means for engaging and following the guide means, whereby the support bracket may pivot in the course of travel along the guide means; and composite means for controlling pivoting of the support bracket in the course of travel, said composite means comprising an elongated first part supported by the corner bracket and a second part connected with the support bracket, the second part being adapted to engage the first part so that pivoting of the support bracket is responsive to the shaping of the first part;

wherein the curvilinear guide means is a corner track section; and wherein the first part of the composite means is an elongated cam track having a concave central portion, the cam track forming upper and lower cam surfaces; and the second part of the composite means is a cam follower; the composite means being arranged so that, when the sectional door is opening, the cam follower engages and follows the lower cam surface and, when the door is closing, the cam follower engages and follows the upper cam surface.

2. The guide assembly as set forth in claim 1 wherein the following means of the support bracket is a rotatable roller.

3. The guide assembly as set forth in claim 2 wherein the curvilinear track section has means at each end for connecting with an upwardly extending track section and an inwardly extending track section.

4. The guide assembly as set forth in claim 1 wherein the following means of the support bracket is a rotatable roller.

5. The guide assembly as set forth in claim 4 wherein the curvilinear track section has means at each end for connecting with an upwardly extending track section and an inwardly extending section.

6. The guide assembly as set forth in any one of claims 1 and 2 to 5 wherein the support bracket has a generally triangular configuration and its following means is a rotatable roller mounted to its front apex, the composite means second part is a cam follower connected to its upper apex and its means for pivotally mounting is connected to its rear apex.

7. The guide assembly as set forth in claim 1 wherein the curvilinear track section has means at each end for connecting with an upwardly extending track section and an inwardly extending track section.

* * * * *